US009142920B2

(12) United States Patent
Oyake

(10) Patent No.: US 9,142,920 B2
(45) Date of Patent: Sep. 22, 2015

(54) CONNECTOR WITH DIFFERENTIAL PAIRS

(71) Applicant: Japan Aviation Electronics Industry, Limited, Tokyo (JP)

(72) Inventor: Takayoshi Oyake, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 46 days.

(21) Appl. No.: 14/022,451

(22) Filed: Sep. 10, 2013

(65) Prior Publication Data

US 2014/0106630 A1 Apr. 17, 2014

(30) Foreign Application Priority Data

Oct. 17, 2012 (JP) ..... 2012-229552

(51) Int. Cl.

| | |
|---|---|
| ***H01R 9/24*** | (2006.01) |
| ***H01R 13/6461*** | (2011.01) |
| ***H01R 13/6467*** | (2011.01) |
| *H01R 12/72* | (2011.01) |

(52) U.S. Cl.

CPC ..... *H01R 13/6461* (2013.01); *H01R 13/6467* (2013.01); *H01R 12/724* (2013.01)

(58) Field of Classification Search

USPC ..... 439/884, 660, 941
IPC ..... H01R 13/6471,13/6461, 13/04, 12/724
See application file for complete search history.

(56) References Cited

U.S. PATENT DOCUMENTS

| | | | | |
|---|---|---|---|---|
| 7,845,961 | B2 | 12/2010 | Zhu et al. | |
| 8,011,959 | B1 | 9/2011 | Tsai et al. | |
| 8,142,209 | B2 * | 3/2012 | Zhu et al. | 439/108 |
| 2003/0162446 | A1 | 8/2003 | Ho et al. | |
| 2006/0094292 | A1 | 5/2006 | Shindo | |
| 2007/0197064 | A1 | 8/2007 | Masumoto et al. | |
| 2007/0269996 | A1 * | 11/2007 | Chia | 439/66 |
| 2012/0315796 | A1 * | 12/2012 | Pang et al. | 439/626 |

FOREIGN PATENT DOCUMENTS

| | | | |
|---|---|---|---|
| CN | 201355710 | Y | 12/2009 |
| JP | 3163905 | U | 11/2010 |

(Continued)

OTHER PUBLICATIONS

Office Action mailing date Jan. 28, 2015 from Korean Patent Application KR20130111032 with English translation of relevant parts.

(Continued)

*Primary Examiner* — Vanessa Girardi

(74) *Attorney, Agent, or Firm* — Collard & Roe, P.C.

(57) ABSTRACT

A connector comprises a pair of contacts of the same shape disposed adjacent to each other and an adjacent contact disposed adjacent to the pair of contacts. The pair of contacts and the adjacent contact have, at their one end, contact portions which are arranged parallel to each other at regular intervals and, at their other end, connecting portions which are arranged parallel to each other at regular intervals. Further, the adjacent contact has a deformed portion at an intermediate portion between the contact portion and the connecting portion so as to be partially away from the pair of contacts. Alternatively, the pair of contacts each may have a deformed portion at an intermediate portion between the contact portion and the connecting portion so as to be partially away from the adjacent contact.

11 Claims, 4 Drawing Sheets

(56) References Cited

FOREIGN PATENT DOCUMENTS

| | | | |
|---|---|---|---|
| JP | 2010-287560 | A | 12/2010 |
| KR | 1020070083216 | A | 8/2007 |
| TW | M329880 | U | 4/2008 |
| TW | M400707 | U1 | 3/2011 |
| WO | 2004/038868 | A1 | 5/2004 |

OTHER PUBLICATIONS

Chinese Office Action dated Jun. 2, 2015 in CN 201310425069.4 with English translation of the relevant parts.
Taiwanese Office Action dated Jun. 16, 2015 in TW 102135254 with English translation of the relevant parts.

* cited by examiner

CONNECTOR WITH DIFFERENTIAL PAIRS

This application is based upon and claims the benefit of priority from Japanese Patent Application No. 2012-229552, filed on Oct. 17, 2012, the disclosure of which is incorporated herein in its entirety by reference.

TECHNICAL FIELD

This invention relates to a connector and, in particular, relates to a connector which is, for example, suitable for transmission of differential signals.

BACKGROUND ART

There is known a differential transmission system adapted to transmit a differential signal pair, comprising signals having opposite phases, in two signal lines forming a pair. Since the differential transmission system has a feature that a high data transfer rate can be achieved, it has recently been put to practical use in various fields. One example of a connector that can be used for that purpose is disclosed in JP-A-2010-287560 (hereinafter referred to as "Patent Document 1").

The connector of Patent Document 1 will be described with reference to FIG. 6 showing a terminal array 1 of the connector. The illustrated terminal array 1 comprises a number of terminals of the same shape which are arranged at regular intervals in a row. These terminals are divided into a plurality of ground terminals 2 and a plurality of pairs of signal terminals 3. The signal terminals 3 of each pair are disposed between two adjacent ones of the ground terminals 2. According to this configuration, since each ground terminal 2 is disposed between the adjacent pairs of signal terminals 3, crosstalk between the pairs of signal terminals 3 can be expected to be reduced.

However, as described above, in the connector of Patent Document 1, a number of the terminals of the same shape are arranged at regular intervals in a row. Thus, there arises a problem if the array pitch of the terminals is narrowed to miniaturize the connector. That is, if the array pitch of the terminals is narrowed, the capacitance between the terminals increases so that the impedance decreases, thus leading to degradation of the transmission characteristics. Therefore, the connector of Patent Document 1 is not suitable for application as a Type C Mini HDMI (High Definition Multimedia Interface) connector in which the pitch of a terminal array is narrowed to about 0.4 mm.

SUMMARY OF THE INVENTION

Problem to be Solved by the Invention

It is therefore an object of this invention to provide a connector that can be miniaturized while maintaining desired transmission characteristics thereof.

Means for Solving the Problem

For solving the foregoing problems, this invention provides the following connector.

There is provided a connector comprising a pair of contacts of the same shape disposed adjacent to each other and an adjacent contact disposed adjacent to the pair of contacts, wherein the pair of contacts and the adjacent contact have, at their one end, contact portions which are arranged parallel to each other at regular intervals and, at their other end, connecting portions which are arranged parallel to each other at regular intervals, and wherein the adjacent contact has a deformed portion at an intermediate portion between the contact portion and the connecting portion so as to be partially away from the pair of contacts.

There is also provided a connector comprising a pair of contacts of the same shape disposed adjacent to each other and an adjacent contact disposed adjacent to the pair of contacts, wherein the pair of contacts and the adjacent contact have, at their one end, contact portions which are arranged parallel to each other at regular intervals and, at their other end, connecting portions which are arranged parallel to each other at regular intervals, and wherein the pair of contacts each have a deformed portion at an intermediate portion between the contact portion and the connecting portion so as to be partially away from the adjacent contact.

Effect of the Invention

A connector of this invention is configured such that a pair of contacts and an adjacent contact are partially away from each other, and therefore, it is possible to achieve miniaturization of the connector while maintaining desired transmission characteristics thereof.

MODE FOR CARRYING OUT THE INVENTION

Figure 1:
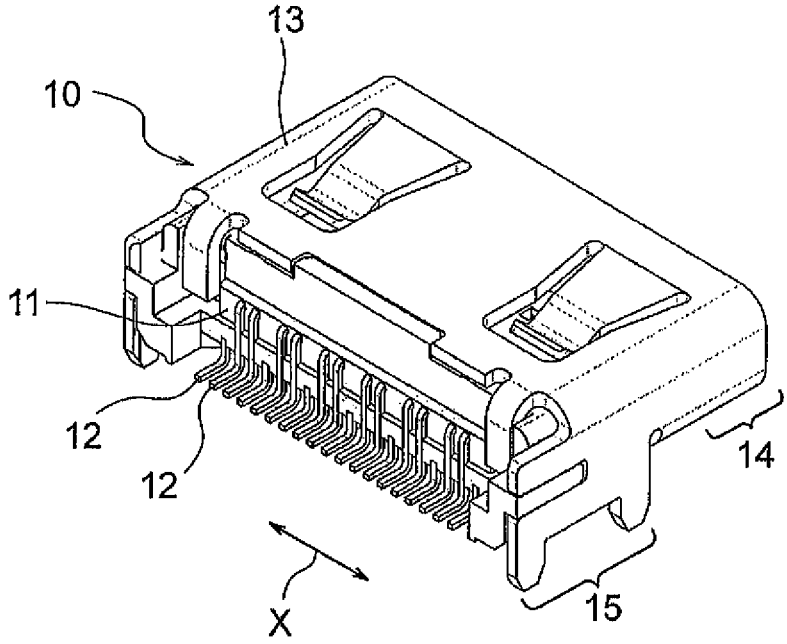
FIG. 1 is a perspective view of a connector according to an embodiment of this invention.
Figure 2:
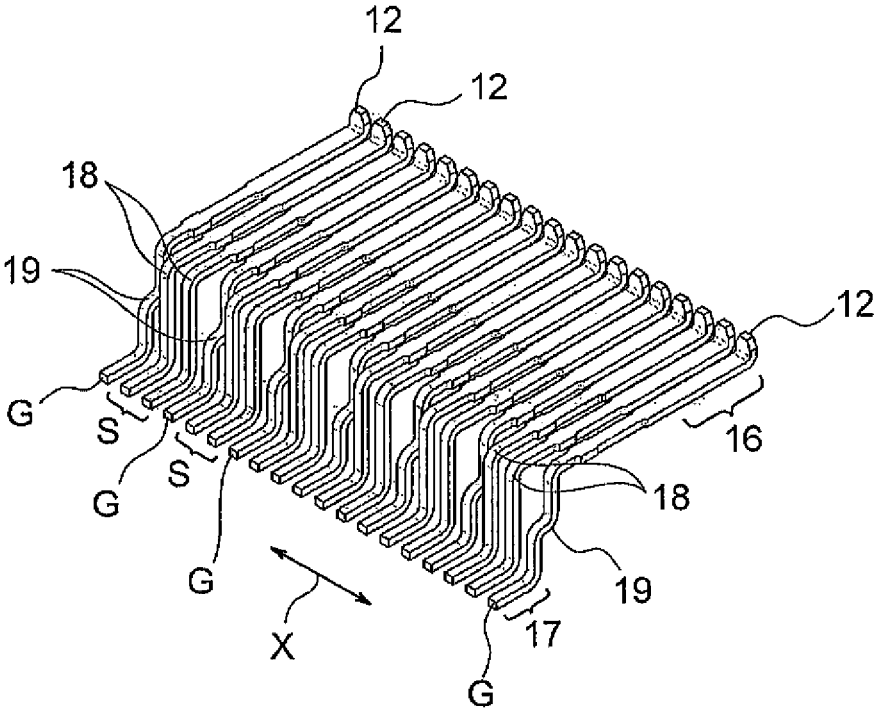
FIG. 2 is an enlarged perspective view showing a contact array assembled in the connector of FIG. 1.

Referring to FIGS. 1 and 2, a connector 10 according to an embodiment of this invention will be described.

The connector 10 shown in FIG. 1 is a Type C Mini HDMI connector that can be mounted on a circuit board (not illustrated). The connector 10 comprises an insulating housing 11, a plurality of conductive contacts 12 arranged in a row and attached to the housing 11, and a shell 13 in the form of a metal plate covering the housing 11. The connector 10 has one end side serving as a connector fitting portion 14 adapted to be fitted to a mating connector (not illustrated) as a connection partner and the other end side serving as a board mounting portion 15 adapted to be mounted on the circuit board.

FIG. 2 shows an array of the contacts 12 which is assembled in the connector 10. The contacts 12 include pairs of contacts S disposed adjacent to each other and adjacent contacts G disposed adjacent to and on both sides of the contacts S of each pair. The contacts S in the array have the same shape as the other contacts S in the array. Each adjacent contact G has the same shape as the other adjacent contacts G in the array. Specifically, the adjacent contacts G and the pairs of contacts S are alternately arranged in a connector width direction X. The adjacent contacts G are disposed at both ends in the connector width direction X of the contact array.

All the contacts 12 (i.e. the pairs of contacts S and the adjacent contacts G) are arranged at a narrow pitch. In particular, contact portions 16 at one end of the contacts 12 are arranged parallel to each other at regular intervals and connecting portions 17 at the other end of the contacts 12 are also arranged parallel to each other at regular intervals. The contact portions 16 are adapted to be brought into contact with the mating connector while the connecting portions 17 are adapted to be connected to the circuit board by soldering or the like.

Herein, the pitch of the contacts 12 is 0.4 mm at the contact portions 16 and the connecting portions 17. The dimension in the connector width direction X, i.e. the width, of each contact portion 16 is 0.25 mm. Accordingly, a clearance gap formed between the contact portions 16 of the contacts 12 adjacent to each other is as extremely narrow as 0.15 mm.

Each of the paired contacts S is formed, at an intermediate portion between the contact portion 16 and the connecting portion 17, with a bent portion 18 which is bent substantially perpendicularly to be convex outward. On the other hand, each of the adjacent contacts G located adjacent to and on both sides of the contacts S of each pair is formed, at an intermediate portion between the contact portion 16 and the connecting portion 17 at a position corresponding to the bent portion 18, with a deformed portion 19 which is bent to be convex inward as opposed to the bent portion 18. By forming the deformed portions 19, the adjacent contacts G are partially away from the paired contacts S while the array pitch of the contacts 12 is maintained constant. Since the adjacent contacts G are partially away from the paired contacts S by bending the adjacent contacts G as described above, it is possible to achieve miniaturization of the connector 10 by narrowing the array pitch of the contacts 12 while maintaining desired transmission characteristics thereof.

Figure 3:
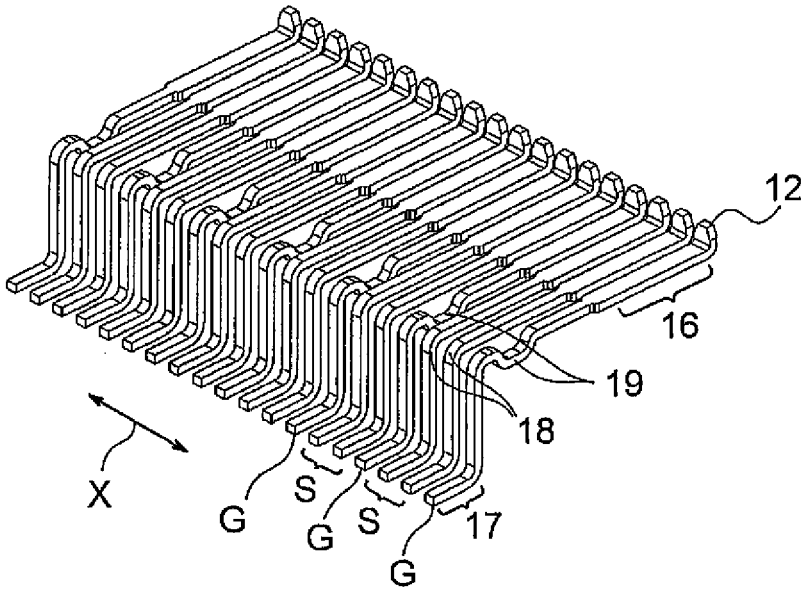
FIG. 3 is a perspective view showing a modification of the contact array of FIG. 2.

As shown in FIG. 3, a deformed portion 19 of each of adjacent contacts G may be formed so as to be slightly offset from a position corresponding to a bent portion 18. In FIG. 3, the deformed portion 19 is deformed inward.

Figure 4:
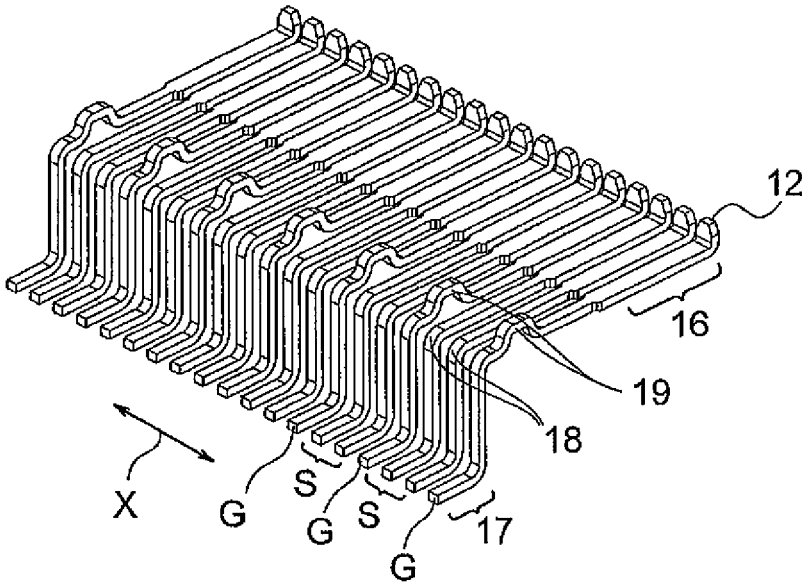
FIG. 4 is a perspective view showing another modification of the contact array of FIG. 2.

As shown in FIG. 4, a deformed portion 19 of each of adjacent contacts G may be deformed outward.

Next, referring to FIG. 5 along with FIG. 1, a connector 10 according to another embodiment of this invention will be described. The same reference symbols are assigned to the same portions as those of the connector 10 shown in FIGS. 1 and 2, thereby omitting description thereof.

Figure 5:
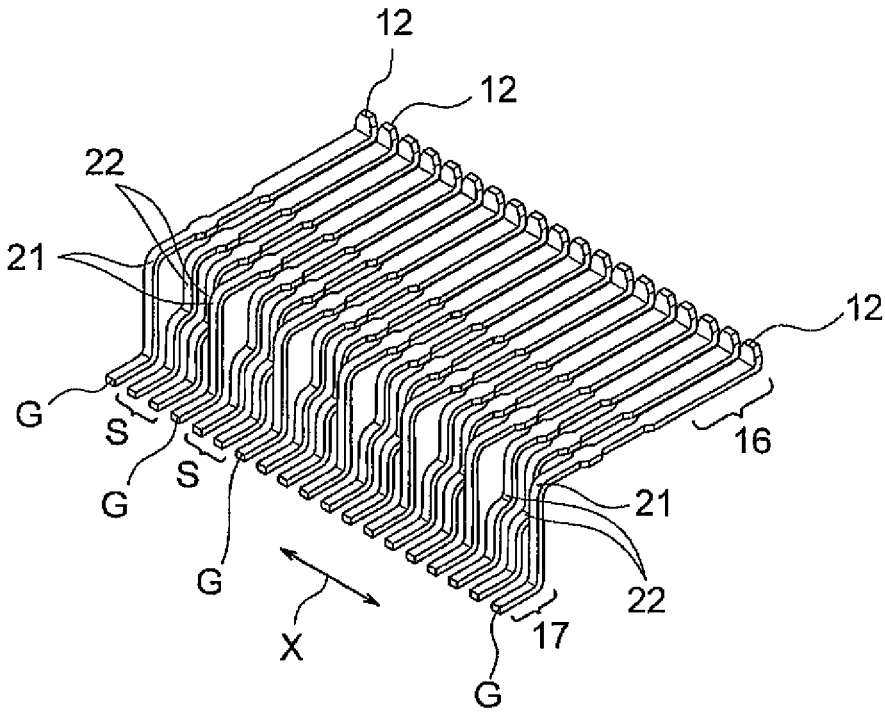
FIG. 5 is a perspective view showing a contact array assembled in a connector according to another embodiment of this invention.
Figure 6:
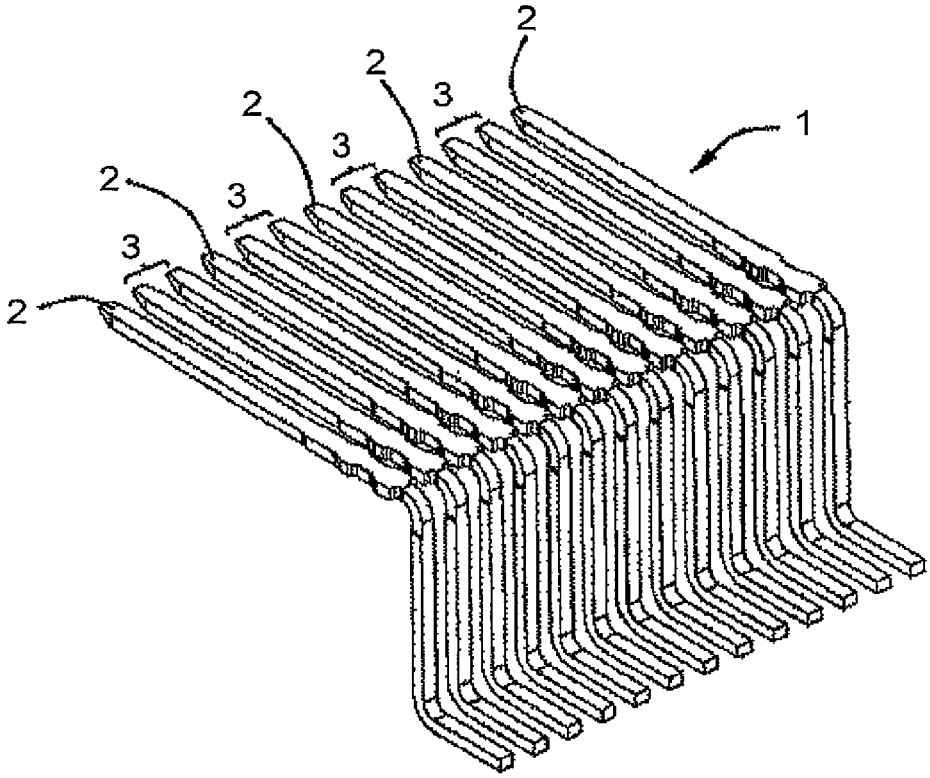
PRIOR ART FIG. 6
FIG. 6 is a perspective view showing a terminal array assembled in a connector of Patent Document 1.

In FIG. 5, each of adjacent contacts G of contacts 12 is formed, at an intermediate portion between a contact portion 16 and a connecting portion 17, with a bent portion 21 which is bent substantially perpendicularly to be convex outward. On the other hand, each of paired contacts S of the contacts 12 is formed, at an intermediate portion between a contact portion 16 and a connecting portion 17 at a position corresponding to the bent portion 21, with a deformed portion 22 which is bent to be convex inward as opposed to the bent portion 21. By forming the deformed portions 22, the paired contacts S are partially away from the adjacent contacts G. Since the paired contacts S are partially away from the adjacent contacts G by bending the paired contacts S as described above, it is possible to achieve miniaturization of the connector 10 by narrowing the array pitch of the contacts 12 while maintaining desired transmission characteristics thereof.

Also in the connector 10 described with reference to FIG. 5, the deformed portion 22 may be formed inward or outward and slightly offset from the position corresponding to the bent portion 21 like in FIG. 3 or 4.

In any of the connectors 10 described above, the paired contacts S are used as signal contacts for transmitting differential signals while the adjacent contacts G are used as ground contacts adapted to be connected to ground. That is, in use of the connector 10, a differential signal pair comprising signals having opposite phases are supplied to the contacts S of each pair while a ground potential is applied to each of the adjacent contacts G.

While this invention has been described with reference to the embodiments, this invention is not limited thereto. For example, the deformed portions may be curved rather than bent, i.e. may be subjected to various modifications as long as the deformed portions are away from the contacts adjacent to each other while the array pitch of the contacts is maintained constant. Those modifications are also included in the scope of this invention.

Part or the whole of the above-mentioned embodiments can also be described as the following supplementary notes, but is not limited thereto.

(Supplementary Note 1)

A connector comprising a pair of contacts of the same shape disposed adjacent to each other and an adjacent contact disposed adjacent to the pair of contacts, wherein the pair of contacts and the adjacent contact have, at their one end, contact portions which are arranged parallel to each other at regular intervals and, at their other end, connecting portions which are arranged parallel to each other at regular intervals, and wherein the adjacent contact has a deformed portion at an intermediate portion between the contact portion and the connecting portion so as to be partially away from the pair of contacts.

(Supplementary Note 2)

The connector according to the supplementary note 1, wherein the deformed portion is formed by bending the adjacent contact so as to be partially away from the pair of contacts.

(Supplementary Note 3)

The connector according to the supplementary note 1 or 2, further comprising an additional adjacent contact disposed adjacent to the pair of contacts on a side opposite to the aforementioned adjacent contact, wherein the additional adjacent contact also has a deformed portion at an intermediate portion between a contact portion and a connecting portion so as to be partially away from the pair of contacts.

(Supplementary Note 4)

The connector according to the supplementary note 3, wherein the deformed portion of the additional adjacent contact is formed by bending the additional adjacent contact so as to be partially away from the pair of contacts.

(Supplementary Note 5)

The connector according to any one of the supplementary notes 1 to 4, wherein the pair of contacts each have a bent portion at an intermediate portion between the contact portion and the connecting portion, and wherein the deformed portion of the adjacent contact is bent in a direction opposite to that of the bent portion at a position corresponding to the bent portion.

(Supplementary Note 6)

A connector comprising a pair of contacts of the same shape disposed adjacent to each other and an adjacent contact disposed adjacent to the pair of contacts, wherein the pair of contacts and the adjacent contact have, at their one end, contact portions which are arranged parallel to each other at regular intervals and, at their other end, connecting portions which are arranged parallel to each other at regular intervals, and wherein the pair of contacts each have a deformed portion at an intermediate portion between the contact portion and the connecting portion so as to be partially away from the adjacent contact.

(Supplementary Note 7)

The connector according to the supplementary note 6, wherein the deformed portion is formed by bending each of the pair of contacts so as to be partially away from the adjacent contact.

(Supplementary Note 8)

The connector according to the supplementary note 7, further comprising an additional pair of contacts of the same shape disposed adjacent to each other and adjacent to the adjacent contact on a side opposite to the aforementioned pair of contacts, wherein the additional pair of contacts each also have a deformed portion at an intermediate portion between a contact portion and a connecting portion so as to be partially away from the adjacent contact.

(Supplementary Note 9)

The connector according to the supplementary note 8, wherein the deformed portion of each of the additional pair of contacts is formed by bending each of the additional pair of contacts so as to be partially away from the adjacent contact.

(Supplementary Note 10)

The connector according to any one of the supplementary notes 6 to 9, wherein the adjacent contact has a bent portion at an intermediate portion between the contact portion and the connecting portion, and wherein the deformed portion of each of the pair of contacts is bent in a direction opposite to that of the bent portion at a position corresponding to the bent portion.

(Supplementary Note 11)

The connector according to any one of the supplementary notes 1 to 10, wherein the pair of contacts are used as signal contacts for transmitting differential signals while the adjacent contact is used as a ground contact.

What is claimed is:

1. A connector comprising a pair of contacts of the same shape disposed adjacent to each other and an adjacent contact disposed adjacent to the pair of contacts, wherein each contact of the pair of contacts comprises a connecting portion, a retaining portion, and a contact portion;

the connecting portion, the retaining portion, and the contact portion are arranged on each contact of the pair of contacts in a row in order of the connecting portion, the retaining portion, and the contact portion;

the adjacent contact comprises a connecting portion, a deformed portion, a retaining portion, and a contact portion;

the connecting portion, the deformed portion, the retaining portion, and the contact portion are arranged on the adjacent contact in a row in order of the connecting portion, the deformed portion, the retaining portion, and the contact portion;

the contact portions of the pair of contacts and the adjacent contact are arranged at their one end parallel to each other at regular intervals and the connecting portions of the pair of contacts and the adjacent contact are arranged at their other end parallel to each other at regular intervals;

the retaining portions of the pair of contacts and the adjacent contact are arranged on the same plane;

the adjacent contact is partially away from the pair of contacts at the deformed portion; and each contact of the pair of contacts and the adjacent contact is separated from each other.

2. The connector according to claim 1, wherein the deformed portion is formed by bending the adjacent contact so as to be partially away from the pair of contacts.

3. The connector according to claim 1, wherein the pair of contacts each have a bent portion at an intermediate portion between the contact portion and the connecting portion, and wherein the deformed portion of the adjacent contact is bent in a direction opposite to that of the bent portion at a position corresponding to the bent portion.

4. The connector according to claim 1, wherein the pair of contacts are used as signal contacts for transmitting differential signals while the adjacent contact is used as a ground contact.

5. The connector according to claim 1, further comprising an additional adjacent contact disposed adjacent to the pair of contacts on a side opposite to the aforementioned adjacent contact, wherein the additional adjacent contact also has a deformed portion at an intermediate portion between a contact portion and a connecting portion so as to be partially away from the pair of contacts.

6. The connector according to claim 5, wherein the deformed portion of the additional adjacent contact is formed by bending the additional adjacent contact so as to be partially away from the pair of contacts.

7. A connector comprising a pair of contacts of the same shape disposed adjacent to each other and an adjacent contact disposed adjacent to the pair of contacts, wherein each contact of the pair of contacts comprises a connecting portion, a deformed portion, a retaining portion, and a contact portion;

the connecting portion, the deformed portion, the retaining portion, and the contact portion are arranged on each contact of the pair of contacts in a row in order of the connecting portion, the deformed portion, the retaining portion, and the contact portion;

the adjacent contact comprises a connecting portion, a retaining portion, and a contact portion;

the connecting portion, the retaining portion, and the contact portion are arranged on the adjacent contact in a row in order of the connecting portion, the retaining portion, and the contact portion;

the contact portions of the pair of contacts and the adjacent contact are arranged at their one end parallel to each other at regular intervals and the connecting portions of the pair of contacts and the adjacent contact are arranged at their other end parallel to each other at regular intervals;

the retaining portions of the pair of contacts and the adjacent contact are arranged on the same plane;

each contact of the pair of contacts is partially away from the adjacent contact at the deformed portion; and each contact of the pair of contacts and the adjacent contact is separated from each other.

8. The connector according to claim 7, wherein the adjacent contact has a bent portion at an intermediate portion between the contact portion and the connecting portion, and wherein the deformed portion of each of the pair of contacts is bent in a direction opposite to that of the bent portion at a position corresponding to the bent portion.

9. The connector according to claim 7, wherein the deformed portion is formed by bending each of the pair of contacts so as to be partially away from the adjacent contact.

10. The connector according to claim 9, further comprising an additional pair of contacts of the same shape disposed adjacent to each other and adjacent to the adjacent contact on a side opposite to the aforementioned pair of contacts, wherein the additional pair of contacts each also have a deformed portion at an intermediate portion between a contact portion and a connecting portion so as to be partially away from the adjacent contact.

11. The connector according to claim 10, wherein the deformed portion of each of the additional pair of contacts is formed by bending each of the additional pair of contacts so as to be partially away from the adjacent contact.

* * * * *